US005727337A

United States Patent [19]

Okajima

[11] Patent Number: 5,727,337

[45] Date of Patent: Mar. 17, 1998

[54] SNOWBOARD BOOT

[75] Inventor: Shinpei Okajima, Izumi, Japan

[73] Assignee: Shimano, Inc., Sakai, Japan

[21] Appl. No.: 615,985

[22] Filed: Mar. 12, 1996

[30] Foreign Application Priority Data

Mar. 24, 1995 [JP] Japan ..... 7-89983

[51] Int. Cl.[6] ..... A43C 11/00

[52] U.S. Cl. ..... 36/50.1; 36/115; 24/306

[58] Field of Search ..... 36/50.1, 110, 115; 24/306, 442

[56] References Cited

U.S. PATENT DOCUMENTS

| | | | |
|---|---|---|---|
| 75,048 | 3/1868 | Perley | 36/50.1 |
| 145,776 | 12/1873 | Babbitt | 36/50.1 X |
| 2,662,308 | 12/1953 | Loewengart | 36/50.1 X |
| 4,081,916 | 4/1978 | Salisbury | 36/50.1 |
| 4,282,657 | 8/1981 | Antonious | 36/50.1 |
| 4,296,558 | 10/1981 | Antonious | 36/50.1 |
| 4,677,767 | 7/1987 | Darby | 36/110 X |
| 5,016,327 | 5/1991 | Klausner | 24/442 X |
| 5,042,120 | 8/1991 | Nichols | 36/50.1 X |
| 5,138,777 | 8/1992 | Darby | 36/110 X |

FOREIGN PATENT DOCUMENTS

| | | | |
|---|---|---|---|
| 0 359 703 | 3/1960 | European Pat. Off. . | |
| 2716350 | 8/1995 | France . | |
| 1043723 | 9/1966 | United Kingdom . | |
| 2048646 | 12/1990 | United Kingdom | 36/50.1 |

OTHER PUBLICATIONS

European Search Report for EP 96 30 2028, dated Jul. 7, 1996.

*Primary Examiner*—Ted Kavanaugh
*Attorney, Agent, or Firm*—James A. Deland

[57] ABSTRACT

A fastener for a snowboard boot includes first, second and third loops with corresponding first, second and third connectors. The first connector is connected to a first side of the boot, and the second connector is attached to a second side of the boot. A strap is connected to the third connector. The strap extends from the third connector to the first loop and passes through the first loop. The strap then extends toward the second loop and passes through the second loop. Thereafter, the strap extends toward the third loop, passes through the third loop and extends toward the second loop. The strap may include a hook and loop or other type fastener for securing the free end of the strap in place.

9 Claims, 2 Drawing Sheets

SNOWBOARD BOOT

BACKGROUND OF THE INVENTION

The present invention is directed to footwear and, more particularly, to a snowboard boot.

The difference between a snowboard and skis is that both feet are placed on a single snowboard and face roughly at a right angle to the direction of motion. With a snowboard, there is a great deal of rotational movement (precession) around the leg axis that is perpendicular to the snow plane and goes through a location in the approximate center of the snowboard where the boots of both feet are fixed. In order for the leg energy required for this considerable rotational movement to be transferred efficiently to the snowboard, the snowboard boots should be securely fixed to the snowboard, and the feet should fit snugly into the boots. With conventional fasteners used to secure the boot to the foot, the user must exert a substantial force on the fastener to properly secure the boot to the foot. This can be very difficult for some users.

SUMMARY OF THE INVENTION

The present invention is directed to a snowboard boot which can be secured to the foot very snugly by operating the fastener with much less force than conventional boots. More specifically, the boot uses a simply operated fastener where the force exerted on the boot by the fastener is greater than the force applied to the fastener by the user.

In one embodiment of the present invention, the fastener for the boot includes a first loop disposed on a first side of the boot and a second loop disposed on a second side of the boot. A strap originates on the first side of the boot, extends toward the second loop, passes through the second loop, extends toward the first loop, passes through the first loop and extending toward the second loop. With this construction, a tightening effect equal to that in the past is obtained at a fraction of the effort required in the past.

In a more specific embodiment of the present invention, the fastener for the boot includes first, second and third loops with corresponding first, second and third connectors. The first connector is connected to a first side of the boot, and the second connector is attached to a second side of the boot. A strap is connected to the third connector. The strap extends from the third connector to the first loop and passes through the first loop. The strap then extends toward the second loop and passes through the second loop. Thereafter, the strap extends toward the third loop, passes through the third loop and extends toward the second loop. The strap may include a hook and loop or other type fastener for securing the free end of the strap in place.

DETAILED DESCRIPTION OF THE EMBODIMENTS

Figure 1:
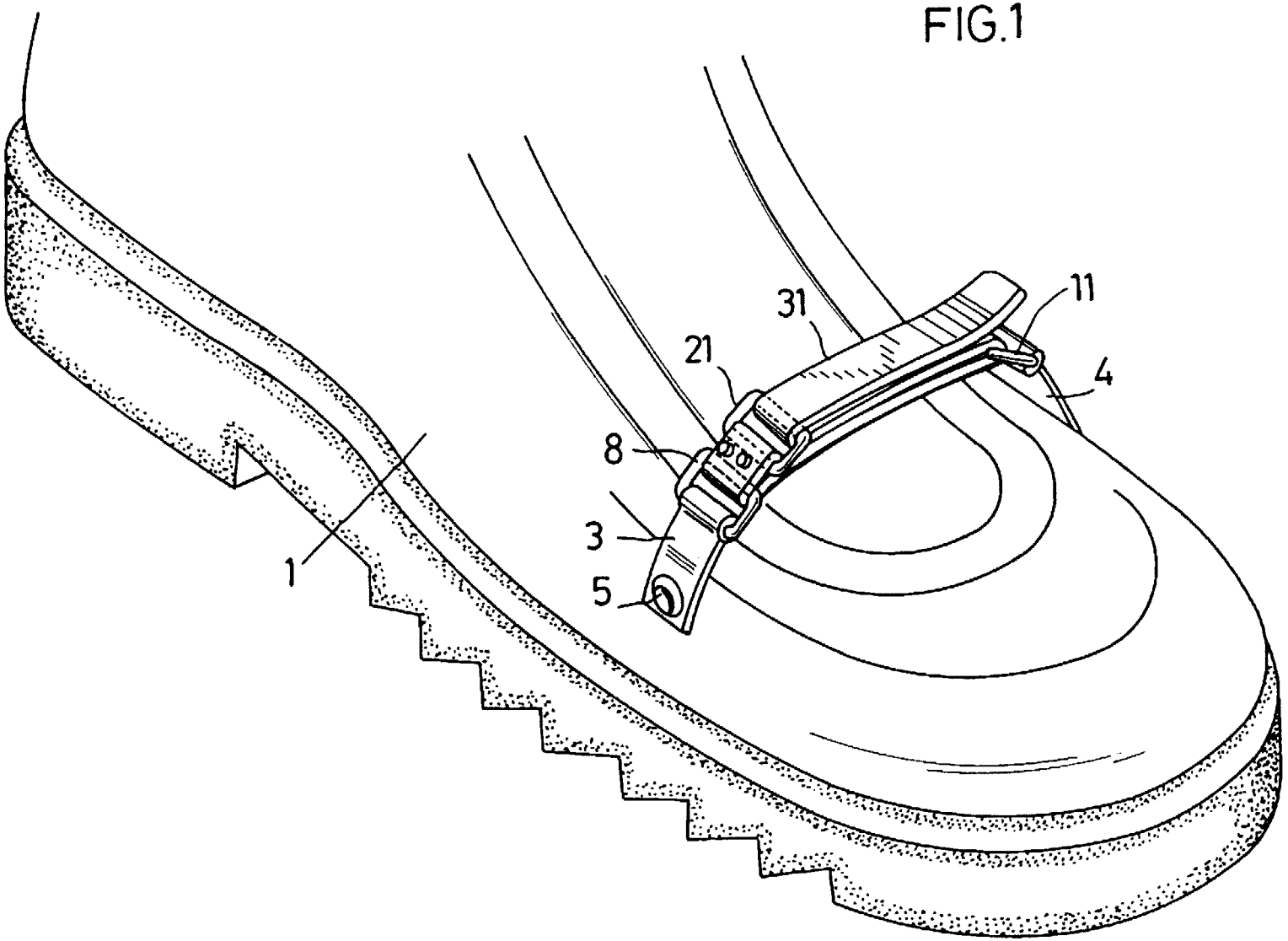
FIG. 1 is a perspective view of a particular embodiment of a snowboard boot according to the present invention.

FIG. 1 is a perspective view of a particular embodiment of a snowboard boot according to the present invention. The snowboard boot body 1 (hereinafter referred to as shoe body) shown in the figure is split along its top surface in the front. A cleat (not shown) that detachably engages with an engagement means provided to the top surface of a snowboard (not shown) is attached to the bottom of the sole of the shoe body 1.

On either side of the front portion of the shoe body 1 are fastened pulling support straps 3 and 4 that elastically support, with respect to the shoe body 1, rings that are pulled as discussed below. The pulling support straps 3 and 4 are fastened to the shoe body 1 at their respective fastened ends 5 and 6 by a known means, such as stitching or eyelets. A first loop in the form of a ring 8 is attached to the free end 7 of the pulling support strap 3, and a second loop in the form of a ring 11 is attached to the free end 9 of the pulling support strap 4. The first ring 8 and the free end 7 of the pulling support strap 3 can be joined by stitching or eyelets. In this embodiment, the free end 7 of the pulling support strap 3 is wound around a shaft 10 on one side of the first ting 8, and this wound portion is stitched. The second ring 11 and the free end 9 of the pulling support strap 4 can be joined in a similar manner. The expression "shaft" refers to that portion of the peripheral part of each ring, which is a bent rod that forms a loop and surrounds a hole, over which the strap is folded back. Of course, many structures can function as connectors to secure the pulling support strap 3 to the loop portion of ring 8.

A third ring 21 is elastically fastened to the shoe body 1 via the first ring 8. The three rings, namely, the first ring 8, the second ring 11, and the third ring 21, are each a loop made of a metal, hard resin, ceramic, or other material that slides well and has little frictional resistance against the strap discussed below. The loop can be an oval, a rectangle, or the like, and the center portion is formed as a hole. There is no need for the loop to be a closed loop, and there is no problem in terms of operation if part of it is missing as long as the strap does not come off when a strong tensile force is applied.

A flexible binding strap 31 is fastened to the shaft 16 of the third ring 21 on the fastened end 5 side. The strap 31 folds around the shaft 17 of the first ring 8, passes through the hole in the center of the loop of the first ring 8 and extends toward the second ring 11. Thereafter, the strap 31 folds around the shaft 18 of the second ring 11, passes through the hole in the center of the loop of the second ring 11, and extends toward the third ring 21. Thereafter, the strap 31 folds around the shaft 19 of the third ring 21, passes through the hole in the center of the third ring 21 and extends back toward the second ring 11.

After going through the hole in the loop of the third ring 21, the strap 31 extends straight out and forms a free end 32. This free end 32 has a fine textured pattern that makes it easy to grip, just as with various known binding straps. A first binding means 33 is provided to the back side of a first strap portion 31 a between the free end 32 and the portion of the strap 31 folded back on the third ring 21. A second binding means 34 facing the first binding means 33 is provided to the back side of a second strap portion 31*b* between the portion of the strap 31 folded back on the second ring 11 and the portion of the strap 31 folded back on the third ring 21. Thus, the first binding means 33 and the second binding means 34 make up a paired interfacial binding means which releasably joins the first strap portion 31*a* to the second strap portion 31*b*.

In this embodiment, the first and second binding means 33,34 comprise a hook and loop type fastening means usually referred to by the trademark VELCRO®, which is also known in Japan as magic tape. Any means for securing the free end to the shoe body 1 can be used instead of this binding means. For example, a hook type fastener or a buckle type fastener that fastens by inserting a tongue into a loop may be used instead.

Figure 2:
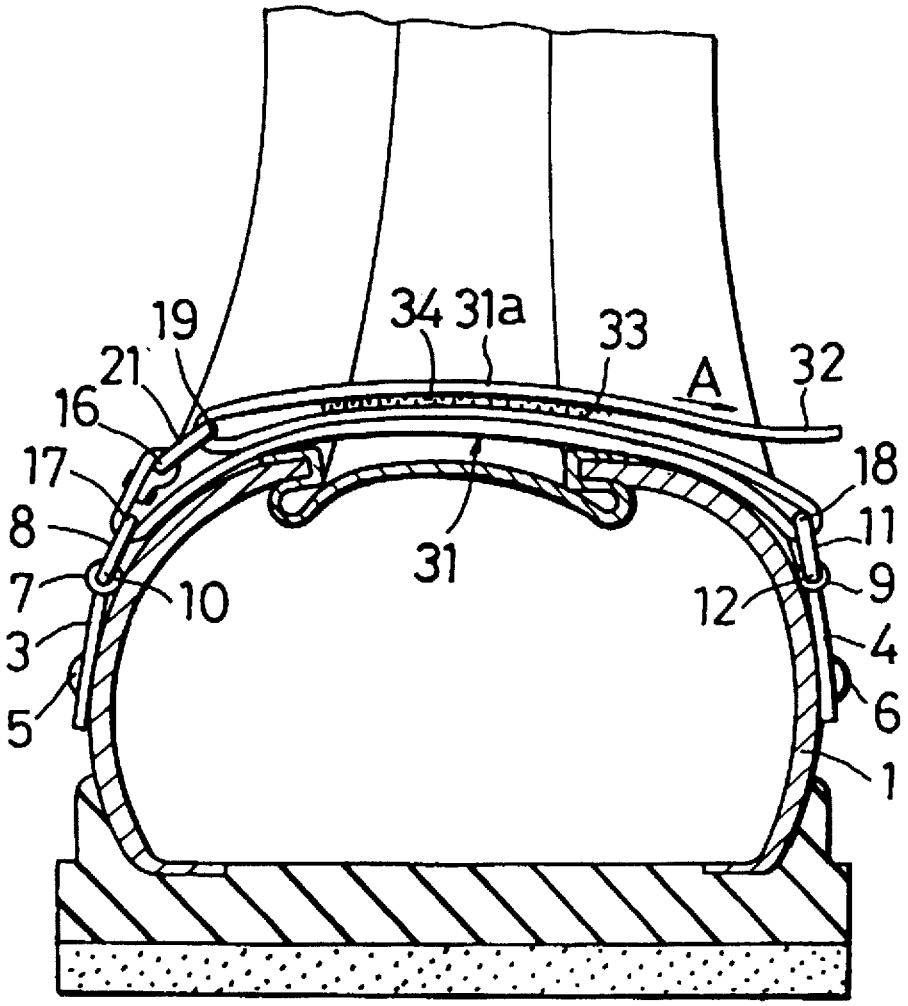
FIG. 2 is a cross sectional view of the snowboard boot of FIG. 1 illustrating the construction of the fastener used to secure the boot to the foot.

In operation, the free end 32 of the strap 31 shown in FIG. 2 is grasped in the fingers and pulled in the direction of arrow A. The strap 31 is continuous from the free end 32 to the end (terminal) located at the shaft 16 of the third ring 21. If we ignore the friction with the rings and the friction of the straps fibers themselves, then the tensile force is equal at all parts of the strap 31. This tensile force is expressed as T.

When the free end 32 is pulled sufficiently, a tensile force of 3T acts on the pulling support strap 3. Similarly, a tensile force of 3T also acts on the pulling support strap 4. To use a pulley as an analogy, the first ring 8 corresponds to the suspension point fixed to the shoe body 1, the second ring 11 corresponds to the moving pulley, and the third ring 21 corresponds to the suspended nonmoving pulley. When a tensile force of T is applied by the fingers to the strap 31, a tensile force of 3T is applied between the third ring 21 and the second ring 11. Thus, the boot is tightened by the strap 31 at a tension that is three times the force applied by the fingers.

When the free end 32 moves 2L cm in the pulling direction, the third ring 21 and the second ring 11 draw closer to each other, so the second strap portion **31*b* moves by L cm. Accordingly, the first binding means 33 should be provided in a length that is twice the length of the second binding means 34. When a tensile force is applied and the first binding means 33 and the second binding means 34 are interfacially fastened, the shoe body 1** is tightened at a tensile force that corresponds to a two-fold tensile force of 2T.

While the above is a description of various embodiments of the present invention, further modifications may be employed without departing from the spirit and scope of the present invention. For example, the first ring 8 can be omitted, and the third ring 21 may be fastened directly to the pulling support strap 3. In this case everything is exactly the same in terms of applying a tightening force of 3T to the boot at a pulling force of T.

Thus, the scope of the invention should not be limited by the specific structures disclosed. Instead, the true scope of the invention should be determined by the following claims. Of course, although labeling symbols are used in the claims in order to facilitate reference to the figures, the present invention is not intended to be limited to the constructions in the appended figures by such labeling.

What is claimed is:

1. A boot comprising:

a boot body (1);

a first loop (21) disposed on a first side of the boot (1);

a second loop (11) disposed on a second side of the boot (1);

a strap (31) originating at the first loop (21), wherein the strap (31) extends from the first loop (21) toward the second loop (11) for forming a first strap segment, wherein the strap (31) then passes through the second loop (11) and extends back toward the first loop (21) for forming a second strap segment, and wherein the strap (31) then passes through the first loop (21) and extends back toward the second loop (11) for forming a third strap segment.

2. The boot according to claim 1 wherein the first strap segment, the second strap segment and the third strap segment together overlap each other.

3. A boot comprising:

a boot body (1);

a first loop (8) having a first connector (10), the first connector (10) being connected to a first side of the boot (1);

a second loop (11) having a second connector (12), the second connector (12) being attached to a second side of the boot (1);

a third loop (21) having a third connector (16);

a strap (31) connected to the third connector (16);

wherein the strap (31) extends from the third connector (16) to the first loop (8), passes through the first loop (8) and extends toward the second loop (11) for forming a first strap segment, wherein the strap (31) then passes through the second loop (11) and extends back toward the third loop (21) for forming a second strap segment, and wherein the strap (31) then passes through the third loop (21) and extends back toward the second loop (11) for forming a third strap segment;

wherein the first strap segment, the second strap segment and the third strap segment together overlap each other.

4. The boot according to claim 3 wherein the first loop (8) is elastically connected to the first side of the boot, and wherein the second loop (11) is elastically connected to the second side of the boot.

5. The boot according to claim 3 wherein the strap (31) is formed from a flexible material.

6. The boot according to claim 3 wherein the first loop (8), the second loop (11) and the third loop (21) are each formed as a closed ring.

7. The boot according to claim 3 further comprising fastening means (33,34) for fastening a first portion (**31*a*) of the strap (31) to a second portion (31*b*) of the strap (31**).

8. The boot according to claim 7 wherein the first portion (**31*a*) of the strap (31) extends from the third loop (21) toward the second loop (11), and wherein the second portion (31*b*) of the strap (31) extends from the second loop (11) toward the third loop (21**).

9. The boot according to claim 8 wherein the fastening means (33,34) comprises a hook and loop fastener disposed between the first portion (**31*a*) of the strap (31) and the second portion (31*b*) of the strap (31**).

* * * * *